US006877174B2

(12) United States Patent
Lobry

(10) Patent No.: US 6,877,174 B2
(45) Date of Patent: Apr. 12, 2005

(54) SUSPENSION DEVICE FOR A TWO-SLAT UNIT

(75) Inventor: Jacques Lobry, Bourges (FR)

(73) Assignee: Tournadre S.A. Standard Gum, Bourges (FR)

( * ) Notice: Subject to any disclaimer, the term of this patent is extended or adjusted under 35 U.S.C. 154(b) by 0 days.

(21) Appl. No.: 10/834,897

(22) Filed: Apr. 28, 2004

(65) Prior Publication Data

US 2005/0000018 A1 Jan. 6, 2005

(30) Foreign Application Priority Data

Apr. 30, 2003 (FR) ..... 03 05311

(51) Int. Cl.[7] ..... A47C 23/06

(52) U.S. Cl. ..... 5/238; 5/236.1

(58) Field of Search ..... 5/238, 236.1, 237, 5/239, 241, 191

(56) References Cited

U.S. PATENT DOCUMENTS

| | | | | | |
|---|---|---|---|---|---|
| 4,222,134 | A | * | 9/1980 | Degen | 5/191 |
| 4,251,891 | A | * | 2/1981 | Degen | 5/191 |
| 4,567,615 | A | * | 2/1986 | Fanti | 5/191 |
| 4,696,070 | A | * | 9/1987 | Degen | 5/238 |
| 4,703,526 | A | * | 11/1987 | Degen | 5/237 |
| 4,752,981 | A | * | 6/1988 | Salens | 5/238 |
| 5,282,285 | A | * | 2/1994 | de Gelis et al. | 5/237 |
| 5,774,911 | A | * | 7/1998 | Stube et al. | 5/236.1 |
| 5,924,149 | A | * | 7/1999 | Weber | 5/238 |
| 6,073,281 | A | * | 6/2000 | Huber | 5/238 |
| 6,219,863 | B1 | * | 4/2001 | Loberg et al. | 5/236.1 |
| 6,237,170 | B1 | * | 5/2001 | Salens | 5/236.1 |
| 6,701,550 | B2 | * | 3/2004 | Baeriswyl | 5/236.1 |
| 2002/0178498 | A1 | * | 12/2002 | Baeriswyl | 5/200.1 |
| 2004/0107499 | A1 | * | 6/2004 | Verschuere et al. | 5/236.1 |

FOREIGN PATENT DOCUMENTS

| | | | | | |
|---|---|---|---|---|---|
| DE | 3101215 | A1 | * | 8/1982 | A47C/23/06 |
| DE | 3718285 | A1 | * | 12/1988 | A47C/23/06 |
| DE | 3903440 | A1 | * | 5/1990 | A47C/23/06 |
| DE | 3932340 | A1 | * | 5/1990 | A47C/23/06 |
| DE | 296 11 876 | U | | 8/1997 | |
| EP | 150873 | A1 | * | 1/1985 | A47C/23/06 |
| EP | 366065 | A1 | * | 10/1989 | A47C/23/06 |
| EP | 397069 | A1 | * | 5/1990 | A47C/23/06 |
| EP | 428227 | A1 | * | 5/1991 | A47C/23/06 |
| EP | 444731 | A1 | * | 9/1991 | A47C/23/06 |
| EP | 512569 | A1 | * | 11/1992 | A47C/23/06 |
| EP | 783856 | A1 | * | 7/1997 | A47C/23/06 |
| EP | 1 034 726 | A | | 9/2000 | |
| FR | 2670101 | A1 | * | 6/1992 | A47C/23/06 |
| FR | 2 757 754 | A | | 7/1998 | |
| FR | 2 819 162 | A | | 7/2002 | |
| WO | WO 97/08975 | | * | 3/1997 | A47C/23/06 |

* cited by examiner

*Primary Examiner*—Robert G. Santos
(74) *Attorney, Agent, or Firm*—James Ray & Associates

(57) ABSTRACT

The invention provides a device for suspending slats of a bed base, the device being constituted by a one-piece unit presenting a top section having two housings for receiving the ends of two parallel slats, a bottom section provided with anchor means to anchor said unit to a bed frame, and an intermediate section connecting the top section to the bottom section and constituting the resilient suspension element, said bottom section having a vertical bottom wall for bearing against an inside face of said frame and a horizontal top wall for resting on the top face of said frame, and said unit presenting a vertical plane of symmetry perpendicular to said top wall and to said bottom wall, wherein the intermediate section is constituted by semicylindrical wall portions that are substantially bodies of revolution about axes perpendicular to the plane of symmetry, said wall portions connecting the top section to the bottom section, and said axes of revolution being disposed inside the volume defined by said top section, said bottom section, and said semicylindrical wall portions.

13 Claims, 3 Drawing Sheets

SUSPENSION DEVICE FOR A TWO-SLAT UNIT

The invention relates to the field of resiliently suspending slats in a slatted bed base.

More precisely, the invention relates to a device for suspending slats of a bed base, the device being constituted by a one-piece unit presenting a top section having two housings for receiving the ends of two parallel slats, a bottom section provided with anchor means to anchor said unit to a bed frame, and an intermediate section connecting the top section to the bottom section and constituting a resilient suspension element, said bottom section having a vertical bottom wall for bearing against an inside face of said frame and a horizontal top wall for resting on the top face of said frame, and said unit presenting a vertical plane of symmetry perpendicular to said top wall and to said bottom wall.

BACKGROUND OF THE INVENTION

In this type of two-slat unit, the suspension elements are placed above the long sides of the frame, and are therefore visible. In general, the suspension element presents elastic walls that extend parallel to the slats.

The outside ends of these walls are therefore visible, where the term "outside" is used relative to the frame of the bed base, and a person making a bed (in the sense of putting sheets and blankets into place) can trap the fingers in the channels defined by the elastic walls. In addition, this disposition of the suspension walls gives rise to problems in preventing the slats from pivoting about their own axes.

OBJECT AND SUMMARY OF THE INVENTION

The object of the invention is to mitigate these drawbacks.

The invention achieves this object by the fact that the intermediate section is constituted by semicylindrical wall portions that are substantially bodies of revolution about axes perpendicular to the plane of symmetry, said wall portions connecting the top section to the bottom section, and said axes of revolution being disposed inside the volume defined by said top section, said bottom section, and said semicylindrical wall portions.

Thus, the elastic walls extend parallel to the long side fitted with the units, thereby increasing the stiffness of the housing in twisting, and eliminating to a large extent the laterally-open orifices, and also improving the appearance of the bed base.

Preferably, seen in a direction parallel to the axis of revolution, the intermediate section forms an oval tube.

Advantageously, the top section comprises two gussets defining said housings and a horizontal link wall interconnecting said two gussets.

By way of example, said semicylindrical wall portions comprise a middle wall portion connected to the link wall of the gussets, and to the horizontal top wall of the bottom section, together with two side wall portions disposed on a side of the axis of revolution that is opposite from the side on which said middle wall portion is disposed, and connected to said gussets and to said horizontal top wall.

It is these semicircular side wall portions that make it more difficult for the slats to pivot about their longitudinal axes.

Preferably, the middle wall portion is disposed beside the vertical bottom wall of the bottom section.

Most advantageously, the semicylindrical wall portions present reinforcing beads along their lateral edges.

In addition, the semicylindrical wall portions include preferred bending zones implemented in the form of wall portions of reduced thickness extending parallel to the axes of revolution.

These last two dispositions leave room for the gussets to move without the slats pivoting about their longitudinal axes.

In order to provide better support for the bedding, the gussets are also interconnected on the outside of the frame by a sloping wall.

BRIEF DESCRIPTION OF THE DRAWINGS

Other advantages and characteristics of the invention will appear on reading the following description made by way of example and with reference to the accompanying drawings, in which.

MORE DETAILED DESCRIPTION

Figure 1:
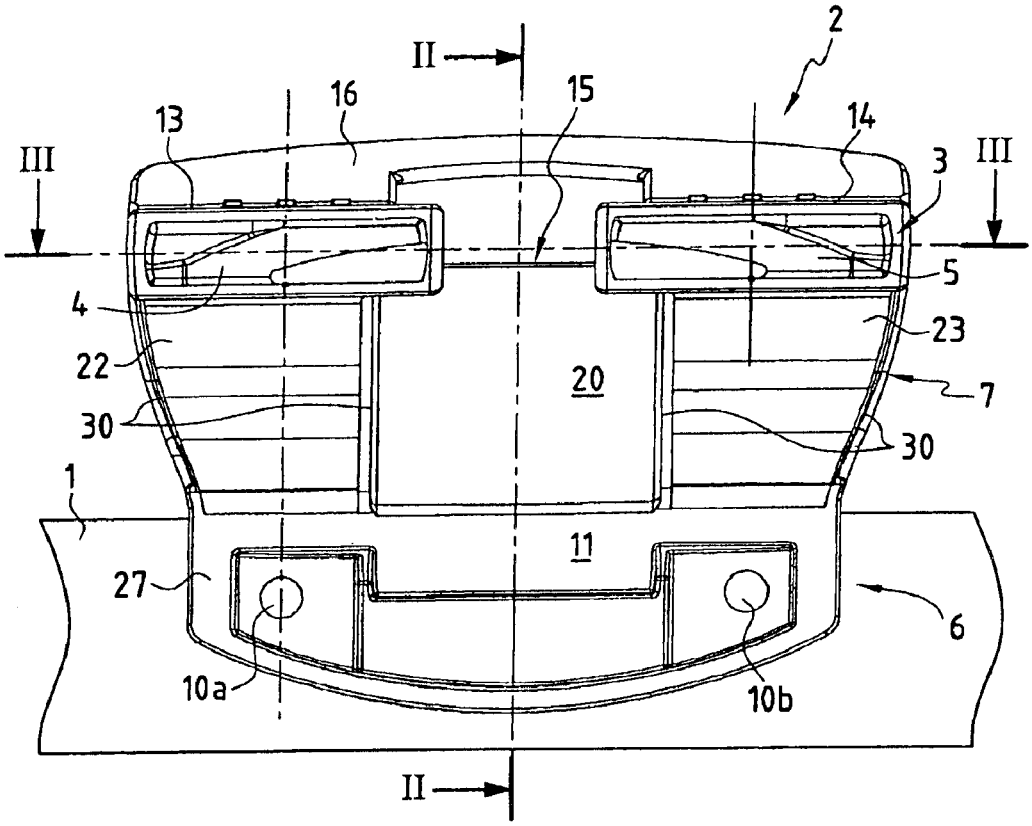
FIG. 1 is a face view of the unit of the invention, situated on the inside of the frame of a bed base.
Figure 2:
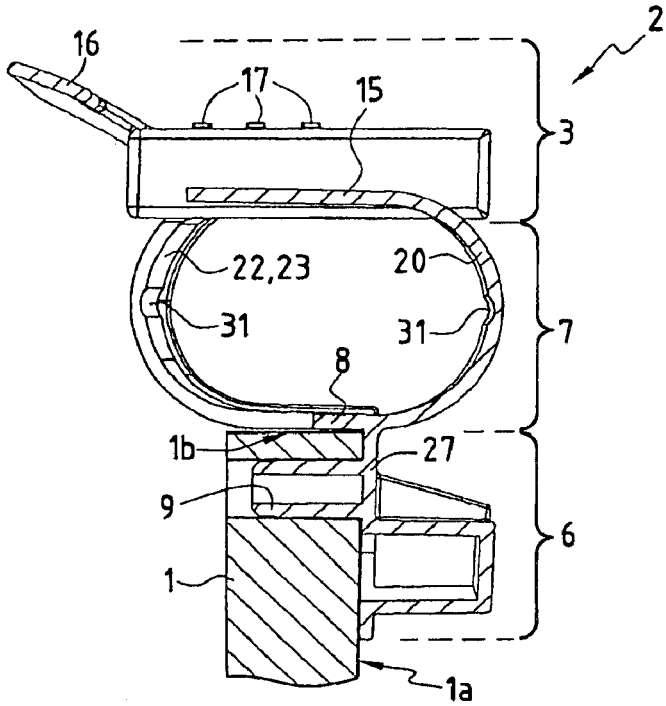
FIG. 2 is a section on line II—II of FIG. 1, this line corresponding to the vertical plane of symmetry.
Figure 3:
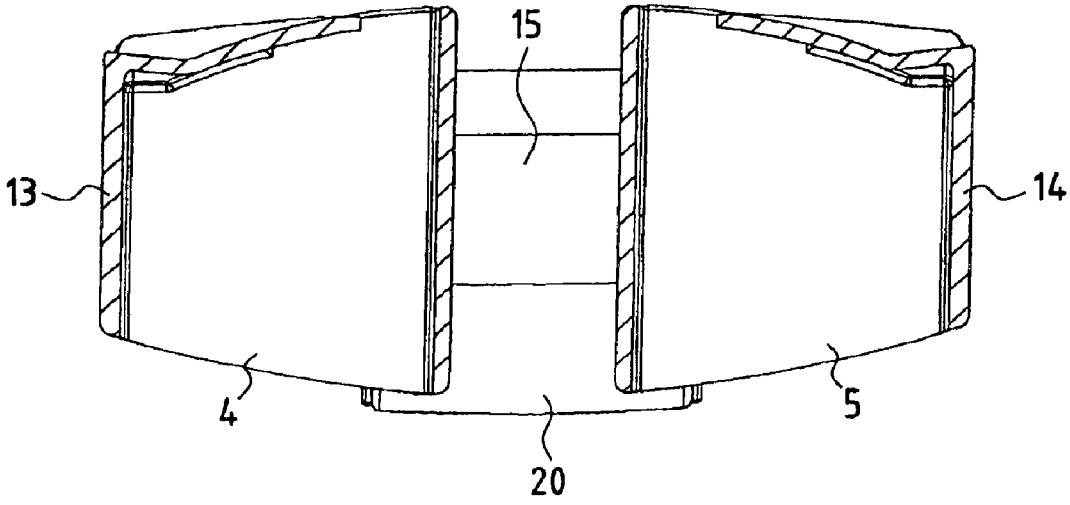
FIG. 3 is a section view on line III—III of FIG. 1.
Figure 4:
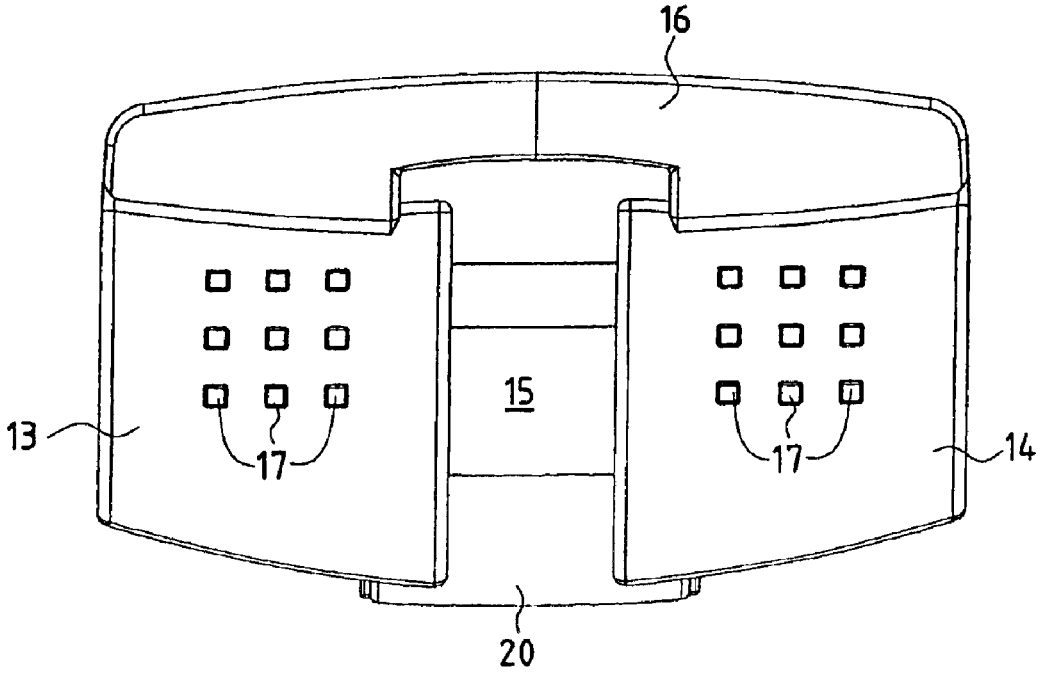
FIG. 4 is a plan view of the FIG. 1 unit.
Figure 5:
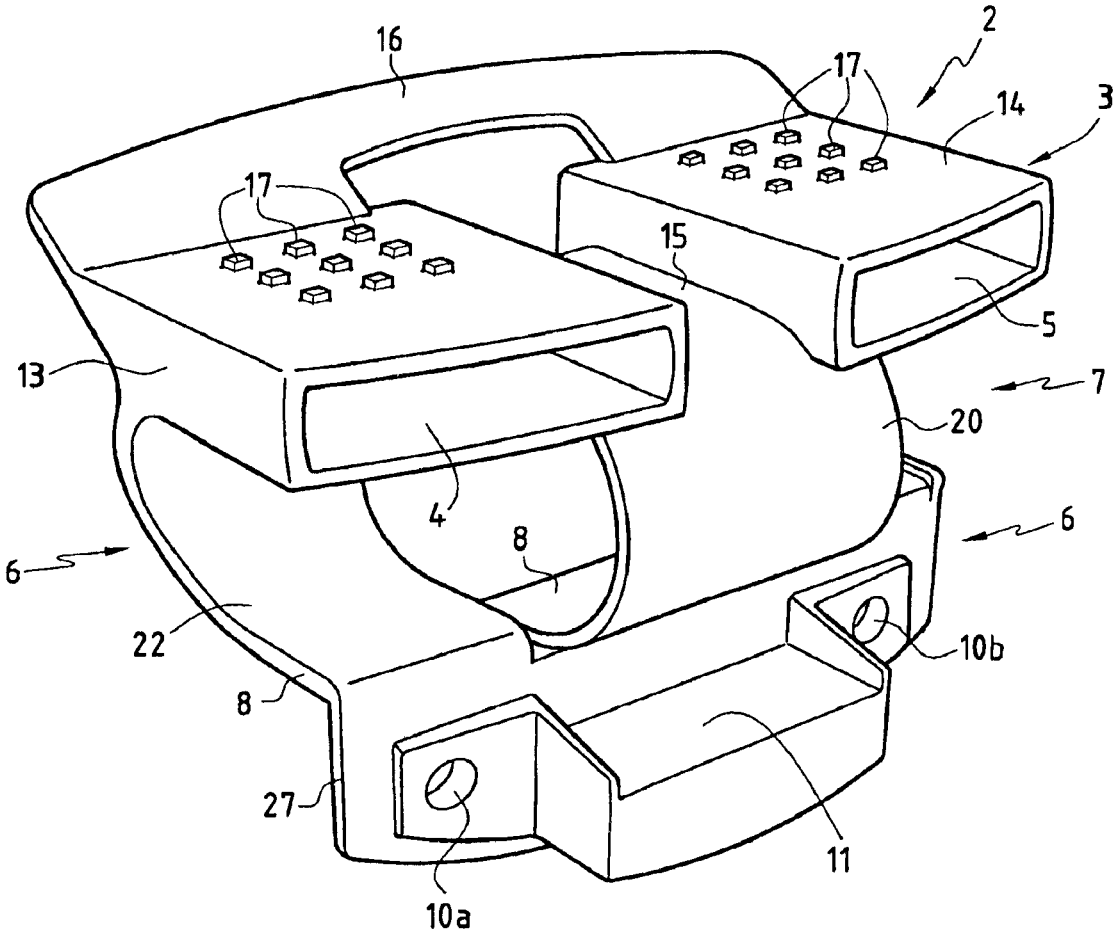
FIG. 5 is a perspective view of the unit of the invention.

In FIGS. 1 and 2, reference 1 designates a long side of the frame of a slatted bed base having mounted thereon a unit 2 of the invention. The long side 1 is not shown in the other figures for reasons of clarity.

The unit 2 is made as a single piece of elastomer material and presents a top section 3 having two housings 4 and 5 for receiving the ends of two parallel slats, a bottom section 6 of upside-down L-shape which is provided with means for anchoring to the long side 1, and an intermediate section 7 connecting the top section 3 to the bottom section 6.

The bottom section 6 of upside-down L-shape has a vertical bottom wall 27 which comes to bear against the inside face la of the long side 1, and a horizontal top wall 8 which rests on the top face 1*b* of the long side 1. The means for anchoring the bottom section 6 to the long side 1 comprise, in particular, a tenon 9 for being received in a hole formed in the long side 1.

In addition to the tenon 9, the bottom wall 27 presents two orifices 10*a* and 10*b* suitable for receiving fastening screws. Fastening could also be performed by stapling.

The tenon 9 is formed on the rear face of the bottom wall 27, and the front face of the bottom wall presents a receptacle 11 that is integrally molded with the unit 2 and that serves to receive the end of a bottom slat.

The top section 3 has two parallel gussets 13 and 14 which define housings 4 and 5. The gussets 13 and 14 are interconnected via their bottom walls by a horizontal link wall 15, and via their top walls by a sloping wall 16 that extends towards the outside of the frame of the bed base that includes the long side 1 and that is intended to retain the edge of bedding.

The top walls of the gussets 13 and 14 present anti-slip projections 17 that also serve to retain the bedding.

The unit 2 presents a vertical plane of symmetry defined by the line II—II in FIG. 1, extending perpendicularly to the bottom wall 27 and to the top wall 8 of the bottom section 6.

In the invention, the intermediate section 7 presents a plurality of semicylindrical wall portions that are substantially bodies of revolution about axes perpendicular to the vertical plane of symmetry, the axes of revolution being disposed between the wall portions situated on the inside of the bed frame and the wall portions situated on the outside of the bed frame, these wall portions together with the top wall 8 of the bottom section 6 and the link wall 15 constituting an oval tube when seen in a direction perpendicular to the vertical plane of symmetry.

As can be seen in the drawings, the intermediate section 7 presents on the inside of the bed frame a semicylindrical middle wall portion 20 which is connected at its top end to the link wall 15 and at its sides to the bottom walls of the gussets 14 and 15 beneath the orifices of the housings 4 and 5, and at its bottom end to the top wall 8 of the bottom section 6. As can be seen in FIG. 2, the link wall 15, the middle wall portion 20, and the bottom wall are of substantially the same thickness and together form an arch.

On the outside of the bed frame, two semicircular side wall portions 22 and 23 are provided that connect the bottom walls of the gussets 13 and 14 to the horizontal top wall 8 of the bottom section 6. In the direction perpendicular to the plane of symmetry, the two side wall portions 22 and 23 are disposed on either side of the middle wall portion 20. However, these side wall portions 22 and 23 could overlap part or all of the middle wall portion 20 without going beyond the ambit of the invention. In particular, the two side wall portions 22 and 23 could form a single semicylindrical wall portion extending over the entire width of the unit 2, said width being measured in the direction perpendicular to the plane of symmetry defined by the line II—II in FIG. 1. The thickness of the side wall portions 22 and 23 is also substantially equal to the thickness of the top wall 8 of the bottom section 6.

The web forming the semicylindrical wall portions 20, 22, and 23 can be continuous. However it may also include a plurality of small through orifices for reasons of appearance or to obtain a desired degree of flexibility.

Advantageously, and as can be seen in FIG. 1, the side edges of the wall portions 20, 22, and 23 present stiffening beads 30 for increasing their stiffness. The wall portions 20, 22, and 23 also present wall portions 31 of reduced thickness in their middle zones extending perpendicularly to the vertical plane of symmetry and constituting zones of preferred bending for said wall portions when loaded.

In the preferred embodiment described above, the middle wall portion 20 is situated on the inside of the bed frame and the side wall portions 22 and 23 are situated on the outside of the frame. It is clear to the person skilled in the art that the middle wall portion could be situated on the outside of the frame and the two side wall portions could be disposed on the inside, without going beyond the ambit of the invention.

What is claimed is:

1. A device for suspending slats of a bed base, the device being constituted by a one-piece unit presenting a top section having two housings for receiving the ends of two parallel slats, a bottom section provided with anchor means to anchor said unit to a bed frame, and an intermediate section connecting the top section to the bottom section and constituting the resilient suspension element, said bottom section having a vertical bottom wall for bearing against an inside face of said frame and a horizontal top wall for resting on the top face of said frame, and said unit presenting a vertical plane of symmetry perpendicular to said top wall and to said bottom wall, the intermediate section being constituted by semicylindrical wall portions that are substantially bodies of revolution about axes of revolution perpendicular to the plane of symmetry, said wall portions connecting the top section to the bottom section, and said axes of revolution being disposed inside a volume defined by said top section, said bottom section, and said semicylindrical wall portions.

2. A device according to claim 1, wherein, seen in a direction parallel to the axes of revolution, the intermediate section forms an oval tube.

3. A device according to claim 2, wherein the top section comprises two gussets defining said housings and a horizontal link wall interconnecting said two gussets.

4. A device according to claim 3, wherein said semicylindrical wall portions comprise a middle wall portion connected to the link wall of the gussets, and to a horizontal top wall of the bottom section, together with two side wall portions disposed on a side of the axes of revolution that is opposite from the side on which said middle wall portion is disposed, and connected to said gussets and to said horizontal top wall.

5. A device according to claim 4, wherein the middle wall portion is disposed beside the vertical bottom wall of the bottom section.

6. A device according to claim 1, wherein the semicylindrical wall portions present reinforcing beads along lateral edges thereof.

7. A device according to claim 1, wherein the top section comprises two gussets defining said housings and a horizontal link wall interconnecting said two gussets and wherein the semicylindrical wall portions present reinforcing beads along lateral edges thereof.

8. A device according to claim 1, wherein the top section comprises two gussets defining said housings and a horizontal link wall interconnecting said two gussets, wherein said semicylindrical wall portions comprise a middle wall portion connected to the link wall of the gussets, and to a horizontal top wall of the bottom section, together with two side wall portions disposed on a side of the axes of revolution that is opposite from the side on which said middle wall portion is disposed, and connected to said gussets and to said horizontal top wall, and wherein the semicylindrical wall portions present reinforcing beads along lateral edges thereof.

9. A device according to claim 1, wherein the semicylindrical wall portions include preferred bending zones implemented in the form of wall portions of reduced thickness extending parallel to the axes of revolution.

10. A device according to claim 1, wherein the top section comprises two gussets defining said housings and a horizontal link wall interconnecting said two gussets, and wherein the semicylindrical wall portions include preferred bending zones implemented in the form of wall portions of reduced thickness extending parallel to the axes of revolution.

11. A device according to claim 1, wherein the top section comprises two gussets defining said housings and a horizontal link wall interconnecting said two gussets, wherein said semicylindrical wall portions comprise a middle wall portion connected to the link wall of the gussets, and to a horizontal top wall of the bottom section, together with two side wall portions disposed on a side of the axes of revolution that is opposite from the side on which said middle wall portion is disposed, and connected to said gussets and to said horizontal top wall, and wherein the semicylindrical wall portions include preferred bending zones implemented in the form of wall portions of reduced thickness extending parallel to the axes of revolution.

12. A device according to claim 1, wherein the top section comprises two gussets defining said housings and a horizontal link wall interconnecting said two gussets, and wherein the gussets are also interconnected on the outside of the frame by a sloping wall for supporting bedding.

13. A device according to claim 1, wherein the vertical bottom wall of the bottom section further includes a third housing for receiving the end of a bottom slat.

* * * * *